US010604868B2

(12) United States Patent
Fujita et al.

(10) Patent No.: US 10,604,868 B2
(45) Date of Patent: Mar. 31, 2020

(54) ARTIFICIAL PROTEIN FIBERS FOR HAIR, MANUFACTURING METHOD THEREFOR AND HEAD ACCESSORY CONTAINING SAME

(71) Applicant: Kaneka Corporation, Osaka (JP)

(72) Inventors: Masato Fujita, Hyogo (JP); Yujiro Sonoyama, Hyogo (JP); Sohei Nishida, Hyogo (JP)

(73) Assignee: KANEKA CORPORATION, Osaka (JP)

( * ) Notice: Subject to any disclaimer, the term of this patent is extended or adjusted under 35 U.S.C. 154(b) by 86 days.

(21) Appl. No.: 15/717,272

(22) Filed: Sep. 27, 2017

(65) Prior Publication Data

US 2018/0016709 A1 Jan. 18, 2018

Related U.S. Application Data

(63) Continuation of application No. PCT/JP2016/059488, filed on Mar. 24, 2016.

(30) Foreign Application Priority Data

Mar. 30, 2015 (JP) ..... 2015-069526

(51) Int. Cl.

| | |
|---|---|
| ***D01F 4/00*** | (2006.01) |
| ***D01F 1/10*** | (2006.01) |
| ***A41G 3/00*** | (2006.01) |
| ***A41G 5/00*** | (2006.01) |
| ***D01D 5/22*** | (2006.01) |
| *D01D 5/06* | (2006.01) |

(52) U.S. Cl.

CPC ..... *D01F 4/00* (2013.01); *A41G 3/00* (2013.01); *A41G 3/0083* (2013.01); *A41G 5/004* (2013.01); *A41G 5/0006* (2013.01); *D01D 5/22* (2013.01); *D01F 1/10* (2013.01); *D01D 5/06* (2013.01); *D10B 2211/06* (2013.01)

(58) Field of Classification Search

None

See application file for complete search history.

(56) References Cited

U.S. PATENT DOCUMENTS 3,423,163 A * 1/1969 Magat ..... D06M 14/22 8/184
3,514,385 A * 5/1970 Magat ..... D06M 14/22 522/89
5,344,917 A * 9/1994 Furukawa ..... D01F 4/00 530/356
6,160,096 A * 12/2000 Sakashita ..... D01F 4/00 530/356
2002/0032253 A1* 3/2002 Lorenz ..... C08J 5/045 524/11
2004/0073010 A1* 4/2004 Ueda ..... D06M 11/17 530/356
2004/0237218 A1* 12/2004 Marsh ..... A61K 8/22 8/405
2005/0004318 A1* 1/2005 Ohshiro ..... C08F 2/38 525/329.1
2006/0064823 A1* 3/2006 Marsh ..... A61K 8/22 8/405
2006/0064824 A1* 3/2006 Godfrey ..... A61K 8/0295 8/405
2006/0090368 A1* 5/2006 Uku ..... D02J 1/22 34/380
2008/0185014 A1* 8/2008 Campain ..... A45D 7/06 132/210
2008/0274070 A1* 11/2008 Campain ..... A61K 8/447 424/70.2
2009/0098079 A1* 4/2009 Schiemann ..... A61K 8/046 424/70.11
2009/0173356 A1* 7/2009 Kano ..... A41G 3/0083 132/53
2009/0260646 A1* 10/2009 Masuda ..... A41G 3/0083 132/53
2011/0067723 A1* 3/2011 Bureiko ..... A61K 8/26 132/208
2012/0022037 A1* 1/2012 Terada ..... A61K 8/39 514/188

(Continued)

FOREIGN PATENT DOCUMENTS

EP 0890663 A2 1/1999
EP 1359245 A1 11/2003

(Continued)

OTHER PUBLICATIONS

International Search Report issued in International Application No. PCT/JP2016/059488; dated Jun. 21, 2016 (2 pages).

*Primary Examiner* — Peter A Salamon

(74) *Attorney, Agent, or Firm* — Osha Liang LLP

(57) ABSTRACT

Protein fibers for artificial hair include a polycation, wherein the protein fibers for artificial hair are crosslinked with an organic compound and/or a metal salt, and the protein fibers for artificial hair have curls. A method for producing the protein fibers for artificial hair includes treating artificial protein fibers that are crosslinked with an organic compound and/or a metal salt with a treatment solution containing a polycation, and curling the artificial protein fibers, or curling artificial protein fibers that are crosslinked with an organic compound and/or a metal salt, and treating the curled artificial protein fibers with a treatment solution containing a polycation.

8 Claims, No Drawings

(56) References Cited

U.S. PATENT DOCUMENTS

| | | | | |
|---|---|---|---|---|
| 2013/0220358 | A1* | 8/2013 | Agostino | A61K 8/731<br>132/208 |
| 2015/0053226 | A1* | 2/2015 | Bonauer | A45D 7/04<br>132/204 |
| 2015/0053228 | A1* | 2/2015 | Bonauer | A45D 19/0008<br>132/208 |
| 2015/0053229 | A1* | 2/2015 | Bonauer | A45D 19/0008<br>132/208 |
| 2015/0053231 | A1* | 2/2015 | Bonauer | A45D 19/0008<br>132/208 |
| 2015/0053232 | A1* | 2/2015 | Schofield | A45D 19/02<br>132/208 |
| 2015/0368469 | A1 | 12/2015 | Kato | |
| 2018/0016709 | A1* | 1/2018 | Fujita | A41G 3/00 |

FOREIGN PATENT DOCUMENTS

| | | | |
|---|---|---|---|
| EP | 2003239 | A1 | 12/2008 |
| EP | 2963175 | A1 | 1/2016 |
| JP | H4-308221 | A | 10/1992 |
| JP | H09-250081 | A | 9/1997 |
| JP | H11-323727 | A | 11/1999 |
| JP | 2007-169806 | A | 7/2007 |
| JP | 2007-247116 | A | 9/2007 |
| JP | 2008-274505 | A | 11/2008 |
| JP | 2009-108469 | A | 5/2009 |
| JP | 2013-167035 | A | 8/2013 |
| WO | 02/052099 | A1 | 7/2002 |
| WO | 2014/132889 | A1 | 9/2014 |

* cited by examiner

ARTIFICIAL PROTEIN FIBERS FOR HAIR, MANUFACTURING METHOD THEREFOR AND HEAD ACCESSORY CONTAINING SAME

TECHNICAL FIELD

One or more embodiments of the invention relate to protein fibers for artificial hair, a method for producing the same, and hair ornamental products including the same.

BACKGROUND

Regenerated collagen fibers are protein fibers that have highly characteristic structure derived from collagen, and their feel, gloss, and texture are quite similar to those of human hair, which is a natural protein fiber with sophisticated microstrucuture. For this reason, attempts have been made to use regenerated collagen fibers as fibers for artificial hair.

As raw materials of regenerated collagen fibers, animal skin and bones are generally used. Regenerated collagen fibers are produced by subjecting such raw materials to an alkali treatment or enzyme treatment to obtain water-soluble collagen, and then extruding the water-soluble collagen into an aqueous inorganic salt solution to spin the collagen into regenerated collagen fibers. However, regenerated collagen fibers obtained in such a manner are soluble in water, and thus have poor heat resistance. Therefore, in order to make the regenerated collagen fibers resistant to water and heat, they are treated to be insoluble in water.

As ways to make the regenerated collagen fibers insoluble in water in order to impart water resistance and heat resistance to the fibers, crosslinking the regenerated collagen fibers with aldehyde compounds such as formaldehyde or glutaraldehyde, epoxide compounds, or metal salts such as chrome salt, aluminum salt, or zirconium salt are known.

For example, Patent Document 1 suggests crosslinking regenerated collagen fibers with aldehyde compounds or polyfunctional epoxide compounds to improve water resistance. Patent document 2 suggests crosslinking regenerated collagen fibers with epihalohydrins or hydrogen halide adducts of epihalohydrins to make the fibers insoluble. Patent Document 3 suggests making regenerated collagen fibers water-insoluble using epoxide compounds or metal salts such as zirconium salts or aluminum salts.

Meanwhile, as to hair ornamental products using fibers for artificial hair, curls are given to the fibers by twisting, etc., to impart better styling properties.

PATENT DOCUMENTS

Patent Document 1: JP 1997(H09)-250081 A
Patent Document 2: JP 2009-108469 A
Patent Document 3: WO 2014/132889

However, artificial protein fibers such as regenerated collagen fibers that are crosslinked with epoxide compounds or metal salts described in Patent Documents 1-3 have loosening of curls when being shampooed after the artificial hair is curled. Patent Document 1 discusses a way to reduce crimps and shrinkage at the time of giving a shape to the regenerated collagen fibers, but the fibers have insufficient shampoo resistance after the artificial hair is curled. Patent Document 2 discusses dye fastness, but the fibers have insufficient shampoo resistance after the artificial hair is curled. Patent Document 3 discusses light-colored regenerated collagen fibers having improved heat resistance and wet heat resistance, but the fibers have insufficient shampoo resistance after the artificial hair is curled.

SUMMARY

One or more embodiments of the present invention provide protein fibers for artificial hair with high shampoo resistance that prevent loosening of curls after shampoo, a method for producing the same, and hair ornamental products including the same.

One or more embodiments of the present invention relate to protein fibers for artificial hair. The protein fibers for artificial hair are crosslinked with organic compounds and/or metal salts, and contain polycations. The protein fibers for artificial hair have curls.

Proteins constituting the protein fibers for artificial hair may be at least one selected from the group consisting of collagen, casein, protein derived from soybean meal, protein derived from yeast, protein derived from fish meal, and feather meal. In one or more embodiments, the protein fibers for artificial hair may be water-insoluble regenerated collagen fibers.

The organic compounds may be selected from the group consisting of aldehyde compounds, epihalohydrins, hydrogen halide adducts of epihalohydrins, and polyfunctional epoxide compounds. In one or more embodiments the metal salts may be water-soluble or water-dispersible compounds, a metal ion contained in the metal salts be one selected from the group consisting of aluminum ion, zirconium ion, titanium ion, zinc ion, copper ion, chromium ion and iron ion, and a counterion of the metal ion in the metal salts be one selected from the group consisting of chloride ion, sulfate ion, carbonate ion, nitrate ion, carboxylate ion, 6-diketone, and 6-ketoester.

The protein fibers for artificial hair may contain at least one selected from the group consisting of phosphoric acid based compounds, sulfuric acid based compounds, and carboxylic acid compounds.

The polycations may be polyamine compounds selected from a group consisting of homopolymers of N,N-diallyl-N,N-dimethylammonium salts, copolymers of N,N-diallyl-N,N-dimethylammonium salts, homopolymers of N,N-diallylamine, and copolymers of N,N-diallylamine.

In one or more embodiments proteins constituting the protein fibers for artificial hair may be collagen, the organic compounds may be epihalohydrins and/or hydrogen halide adducts of epihalohydrins, the metal salts may be aluminum salts and/or zirconium salts, and the polycations may be homopolymers of N,N-diallyl-N,N-dimethylammonium salts and/or copolymers of N,N-diallyl-N,N-dimethylammonium salts. In one or more embodiments the epihalohydrins are epichlorohydrin.

One or more embodiments of the present invention also relate to a method for producing the above protein fibers for artificial hair, including: treating artificial protein fibers that are crosslinked with organic compounds and/or metal salts with a treatment solution containing polycations, and curling the artificial protein fibers, or curling artificial protein fibers that are crosslinked with organic compounds and/or metal salts, and treating the curled artificial protein fibers with a treatment solution containing polycations.

One or more embodiments of the present invention also relate to hair ornamental products including the above protein fibers for artificial hair.

The hair ornamental products may further include other synthetic fibers for artificial hair. The hair ornamental products may be one selected from the group consisting of a bundle of fibers for artificial hair, a weave, a wig, a braid, a toupee, a hair extension, and a hair accessory.

One or more embodiments of the present invention provide protein fibers for artificial hair with high shampoo resistance that prevent loosening of curls after shampoo.

DESCRIPTION OF THE EMBODIMENTS

The present inventors have found that artificial protein fibers such as regenerated collagen fibers crosslinked with organic compounds and/or metal salts (hereinafter, also referred to as "crosslinked regenerated collagen fibers") can prevent loosening of curls even after shampoo and thus have high shampoo resistance, by treating the fibers with a treatment solution containing polycations before or after the artificial hair is curled to have the fibers include the polycations while giving lasting curls to the fibers. Incidentally, by being crosslinked with organic compounds and/or metal salts, artificial protein fibers such as regenerated collagen fibers will be water-insoluble protein fibers. In one or more embodiments of the present invention, the regenerated collagen fibers crosslinked with organic compounds and/or metal salts are called water-insoluble regenerated collagen fibers.

The protein constituting the protein fibers for artificial hair may be any protein that can form fibers. In one or more embodiments the protein may be collagen, casein, protein derived from soybean meal, protein derived from yeast, protein derived from fish meal and feather meal, and may be collagen, from the viewpoint of being suitably used as artificial hair.

The organic compounds may be any compounds that can crosslink with protein fibers such as regenerated collagen fibers. Examples of the organic compounds include aldehyde compounds, epihalohydrins, hydrogen halide adducts of epihalohydrins, and polyfunctional epoxide compounds. In one or more embodiments the organic compounds may be epihalohydrins from the viewpoint of efficiency of crosslinking reactions in aqueous solution.

Examples of the aldehyde compounds include formaldehyde and glutaraldehyde.

Examples of the epihalohydrins and the hydrogen halide adducts of epihalohydrins include epichlorohydrin, epibromohydrin, epiiodohydrin, and 1,3-dichlorohydrin. In one or more embodiments, epichlorohydrin may be used from the viewpoint of efficiency of crosslinking reactions in aqueous solution.

Examples of the polyfunctional epoxide compounds include diglycidyl ether and ethylene glycol diglycidyl ether.

The metal salts may be any compounds that can crosslink with protein fibers such as regenerated collagen fibers. The metal salts may be water-soluble or water-dispersible compounds from the viewpoint of processability of fibers. In one or more embodiments a metal ion contained in the metal salts may be one selected from the group consisting of aluminum ion, zirconium ion, titanium ion, zinc ion, copper ion, chromium ion and iron ion, and a counterion of the metal ion may be one selected from the group consisting of chloride ion, sulfate ion, carbonate ion, nitrate ion, carboxylate ion, β-diketone, and β-ketoester. In one or more embodiments the metal salts may be aluminum salts and/or zirconium salts from the viewpoint of easily obtaining light-colored regenerated collagen fibers.

In one or more embodiments the protein fibers for artificial hair may be treated with acid based compounds such as phosphoric acid based compounds (phosphoric acid and its derivatives), sulfuric acid based compounds (sulfuric acid and its derivatives), or carboxylic acid compounds from the viewpoint of imparting shampoo resistance to the fibers to prevent loosening of curls. By being treated with the acid based compounds described above, the protein fibers for artificial hair will contain acid based compounds described above. Examples of the phosphoric acid based compounds include phosphoric acid, phosphate, phosphoric acid derivatives, and phosphate derivatives. Examples of the sulfuric acid based compounds include sulfuric acid, sulfuric acid derivatives, sulfate, and sulfate derivatives. Examples of the carboxylic acid based compounds include carboxylic acid, carboxylate, carboxylic acid derivatives, and carboxylate derivatives.

In one or more embodiments of the present invention, examples of the phosphoric acid include diphosphoric acid, metaphosphoric acid, polyphosphoric acid, and phosphonic acid (phosphorous acid). Examples of the phosphate include diphosphate, metaphosphate, polyphosphate, and phosphonate. Examples of the phosphoric acid derivatives include diphosphoric acid derivatives, metaphosphoric acid derivatives, polyphosphoric acid derivatives, and phosphonic acid derivatives. Examples of the phosphate derivatives include diphosphate derivatives, metaphosphate derivatives, polyphosphate derivatives, and phosphonate derivatives. For example, as the phosphate, sodium dihydrogenphosphate, disodium hydrogenphosphate, and diammonium hydrogenphosphate can be used. As the phosphonic acid derivatives, phenylphosphonic acid can be used. Among these, disodium hydrogenphosphate, phosphonic acid, and diammonium hydrogenphosphate can be used suitably from the viewpoint that they are relatively inexpensive and readily available, and are in a powder form and hence can be handled easily including storage. These phosphoric acid based compounds can be used individually or in combination of two or more.

From the viewpoint of imparting shampoo resistance to fibers to prevent loosening of curls, the polycations may be organic polycations. In one or more embodiments, the polycations may be polyamine compounds such as homopolymers of radically polymerizable monomers having functional groups of primary amine, secondary amine, tertiary amine and those salts or quaternary ammonium salt, or copolymers of radically polymerizable monomers and another copolymer component, or more specifically may be polyamine compounds such as homopolymers of N,N-diallyl-N,N-dimethylammonium salts, copolymers of N,N-diallyl-N,N-dimethylammonium salts and another copolymer component, homopolymers of N,N-diallylamine, or copolymers of N,N-diallylamine and another copolymer component, or more specifically may be quaternary amine compounds such as homopolymers of N,N-diallyl-N,N-dimethylammonium salts, or copolymers of N,N-diallyl-N,N-dimethylammonium salts. An example of the N,N-diallyl-N,N-dimethylammonium salts is N,N-diallyl-N,N-dimethylammonium chloride. The another comonomer to be contained in the copolymer of N,N-diallyl-N,N-dimethylammonium salts is not particularly limited, but examples of the same include (meth)acrylamide, N,N-dimethyl (meth) acrylamide, N,N-diethyl (meth)acrylamide, N,N-dimethylaminopropyl (meth)acrylamide, hydroxyethyl (meth)acrylamide, dimethylamino propylacrylamide methyl chloride quaternary salt, dimethylamino propylacrylamide benzyl chloride quaternary salt, acryloyl morpholine, diacetone acrylamide, methyl (meth)acrylate, ethyl (meth)acrylate, propyl (meth)acrylate, butyl (meth)acrylate, isobutyl (meth) acrylate, N,N-dimethylaminoethyl (meth)acrylic ester, hydroxyethyl (meth)acrylic ester, 3-hydroxypropyl (meth) acrylic ester, 2-hydroxypropyl (meth)acrylic ester, (meth)

acrylic acid, itaconic acid, (meth)allylsulfonic acid, styrenesulfonic acid, 2-acrylamido-2-methylpropanesulfonic acid, vinylsulfonic acid, 2-hydroxyethyl methacrylate acid phosphate, and N-vinylpyrrolidone. The weight average molecular weight of the polyamine compounds is not particularly limited, but in one or more embodiments, it may be 1000 to 400,000, or 2000 to 300,000, or 3,000 to 250,000 from the viewpoint of easy elution during water washing and the viscosity of a treatment solution. In one or more embodiments of the present invention, (meth)acrylic means acrylic and/or methacrylic, and (meth)acrylic acid means acrylic acid and/or methacrylic acid, and (meth)allylsulfonic acid means allylsulfonic acid and/or methallylsulfonic acid.

In one or more embodiments, from the viewpoint of imparting shampoo resistance to fibers to prevent loosening of curls, the protein fibers for artificial hair may be regenerated collagen fibers that are crosslinked with at least one selected from the group consisting of epihalohydrins, hydrogen halide adducts of epihalohydrins, aluminum salts, and zirconium salts, and contain, as polycations, quaternary amine compounds such as homopolymers of N,N-diallyl-N,N-dimethylammonium salts or copolymers of N,N-diallyl-N,N-dimethylammonium salts and another copolymer component. In one or more embodiments the protein fibers for artificial hair may be regenerated collagen fibers that are crosslinked with epihalohydrins and/or hydrogen halide adducts of epihalohydrins as well as aluminum salts and/or zirconium salts, and contain, as polycations, quaternary amine compounds such as homopolymers of N,N-diallyl-N,N-dimethylammonium salts or copolymers of N,N-diallyl-N,N-dimethylammonium salts. In one or more embodiments the epihalohydrins may be epichlorohydrin.

When the regenerated collagen fibers before treatment with polyamine compounds are 100 wt.-%, the regenerated collagen fibers have zirconium salt content that may be 12 wt.-% or more, or 14 wt.-% or more, or 17 wt.-% or more, or 19 wt.-% or more in terms of zirconium oxide ($ZrO_2$), from the viewpoint of heat resistance. The upper limit of the zirconium salt content in the regenerated collagen fibers may be 30 wt.-% or less, or 27 wt.-% or less, or 25 wt.-% or less in terms of zirconium oxide.

The zirconium salts are not particularly limited, but examples of the same include zirconium sulfate, zirconium acetate, and zirconium oxychloride. These zirconium salts can be used individually or in combination of two or more.

The term "in terms of zirconium oxide" as used herein means that the weight of a zirconium compound is expressed in terms of zirconium oxide having the same number of zirconium atoms. For example, 1 g of zirconium oxide is equivalent to 2.3 g of zirconium sulfate, 2.7 g of zirconium acetate, and 1.4 g of zirconium oxychloride. That is, regenerated collagen fibers (100 g) containing 2.3 g of zirconium sulfate correspond to regenerated collagen fibers containing 1 wt.-% of zirconium salt in terms of zirconium oxide.

In one or more embodiments, the regenerated collagen fibers, when containing zirconium salts, may be further treated with phosphoric acid based compounds. Any of those described above can be used as the phosphoric acid based compounds. When the regenerated collagen fibers before treatment with polyamine compounds are 100 wt.-%, the regenerated collagen fibers may have a phosphorus content of 2 wt.-% or more, or 3 wt.-% or more, or 4 wt.-% or more, from the viewpoint of wet heat resistance. The phosphorus content in the regenerated collagen fibers may be 10 wt.-% or less, or 9 wt.-% or less, or 8 wt.-% or less.

In one or more embodiments when the regenerated collagen fibers before treatment with polyamine compounds are 100 wt.-%, the regenerated collagen fibers have an aluminum salt content of 0.5 wt.-% or more, or 1 wt.-% or more, or 3 wt.-% or more in terms of aluminum oxide ($Al_2O_3$), from the viewpoint of heat resistance. The upper limit of the aluminum salt content in the regenerated collagen fibers is not particularly limited, but the aluminum salt content may be 17 wt.-% or less, or 10 wt.-% or less, or 8 wt.-% or less in terms of aluminum oxide.

The aluminum salts are not particularly limited, but examples of the same include aluminum sulfate, aluminum chloride, and aluminum potassium sulfate. These aluminum salts can be used individually or in combination of two or more.

In one or more embodiments of the present invention, the zirconium salt content in terms of zirconium oxide and the aluminum salt content in terms of aluminum oxide in the regenerated collagen fibers can be calculated by measuring the zirconium (Zr) concentration and the aluminum (Al) concentration in the fibers in the manner described below, and then expressing the values obtained in terms of oxide. Farther, in one or more embodiments of the present invention, the phosphorus content in the regenerated collagen fibers can be measured and calculated in the manner described below.

Curls are given to the protein fibers for artificial hair. The shape of the curls is not particularly limited, and may be formed by twisting, winding using a metal cylinder, net processing (YAKI processing), etc. The size of the curls is not particularly limited, and may be determined appropriately depending on the intended use.

In one or more embodiments when the weight of the humidity-controlled regenerated collagen fibers before treatment with polyamine compounds is 100 wt.-%, the regenerated collagen fibers may contain polyamine compounds such as quaternary amine compounds in an amount of 0.01 wt.-% or more, or 0.05 wt.-% or more, or 0.2 wt.-% or more, from the viewpoint of imparting shampoo resistance to fibers to prevent loosening of curls. The upper limit of the content of the polyamine compounds such as quaternary amine compounds in the regenerated collagen fibers may be 20.0 wt.-% or less, or 6.0 wt.-% or less, or 1.0 wt.-% or less. The term "weight of the humidity-controlled regenerated collagen fibers" as used herein is described later.

In one or more embodiments of the present invention, the content of the polyamine compounds such as quaternary amine compounds in the regenerated collagen fibers can be determined based on the deposit efficiency of a treatment solution containing polyamine compounds such as quaternary amine compounds (hereinafter, also referred to as "polyamine compound treatment solution") to the fibers (the amount of the solution absorbed by the fibers), and the concentration of the polyamine compounds such as quaternary amine compounds in the treatment solution. The deposit efficiency of the treatment solution to the regenerated collagen fibers is expressed by the weight ratio with respect to the weight of the humidity-controlled regenerated collagen fibers. Alternatively, the content of the polyamine compounds such as quaternary amine compounds in the regenerated collagen fibers can be measured as below, for example. 0.5 g of finely chopped regenerated collagen fibers is placed in a 200 mL eggplant-shaped flask equipped with a stirrer (e.g., magnetic stirrer bar) and a cooling tube, to which 60 mL of 1N hydrochloric acid is added, followed by heating for 2 hours at 90° C. with stirring. The liquid is then cooled, and the supernatant is separated carefully by decantation. The residue is washed twice with 20 mL of deionized water, and the supernatant and the washing liquid are transferred to a 500 mL eggplant-shaped flask. Then, the liquid is freeze-dried by passing through a sodium hydroxide tube (φ: 2 cm, length: 1 m), and powder obtained is weighed. A specific amount of deionized water is added to the powder to dissolve it uniformly with an ultrasonic cleaner for 1 hour. Then, a part of the liquid is sampled for colloidal titration using potassium polyvinyl sulfonate and toluidine blue (indicator). The adhesion amount of the polyamine compounds to the protein fibers is measured by calculation from a calibration curve obtained from a standard polyamine compound.

The protein fibers for artificial hair can be produced by: treating artificial protein fibers such as regenerated collagen fibers that are crosslinked with organic compounds and/or metal salts with a treatment solution containing polycations, and curling the artificial protein fibers; or curling artificial protein fibers such as regenerated collagen fibers that are crosslinked with organic compounds and/or metal salts, and treating the curled artificial protein fibers with a treatment solution containing polycations.

A method for crosslinking artificial protein fibers such as regenerated collagen fibers with organic compounds and/or metal salts is not particularly limited, and any conventional method can be used. For example, the crosslinking is achieved by a treatment using a solution prepared by dissolving organic compounds such as epihalohydrins or hydrogen halide adducts of epihalohydrins in a solvent such as water, or an aqueous solution of metal salts such as zirconium salts, aluminum salts, etc. Artificial protein fibers may be crosslinked with organic compounds such as epihalohydrins or hydrogen halide adducts of epihalohydrins, and then further crosslinked with metal salts such as zirconium salts, aluminum salts, or the like, from the viewpoint of heat resistance. In the following, the solution used for crosslinking is also referred to as a "crosslinking solution" collectively.

In one or more embodiments the regenerated collagen fibers, when containing zirconium salts, may be further treated with the above phosphoric acid based compounds. For example, the step of treating regenerated collagen fibers after treatment with zirconium salts with phosphoric acid based compounds is not particularly limited as long as the treatment allows the regenerated collagen fibers to contain the phosphoric acid based compounds. The step may be carried out by immersing regenerated collagen fibers after zirconium salt treatment in an aqueous solution containing phosphoric acid based compounds, for example. The temperature of the aqueous solution containing phosphoric acid based compounds is not particularly limited, but may be 70° C. or lower. When the temperature of the aqueous solution containing phosphoric acid based compounds is 70° C. or lower, the regenerated collagen fibers do not denature and the physical properties do not deteriorate.

In order for the regenerated collagen fibers to include both of zirconium salts and aluminum salts, the treatment with aluminum salts and that with zirconium salts can be performed simultaneously using a treatment solution prepared by adding aluminum salts to an aqueous solution of zirconium salts.

The regenerated collagen fibers after treatment with the crosslinking solution and the aqueous solution containing phosphoric acid based compounds is then washed with water, oiled, and dried. The regenerated collagen fibers may be washed with running water for about 10 minutes to 4 hours, for example. As spinning oil emulsions, emulsions containing an amino-modified silicone, polyalkylene glycol, anionic surfactants, cationic surfactants, nonionic surfactants, pluronic-type polyether-based antistatic agents, etc., may be used, for example. In one or more embodiments the drying temperature may be 100° C. or lower, or 75° C. or lower.

In one or more embodiments, the regenerated collagen fibers, when containing zirconium salts, may be subjected to a steam treatment before the treatment with the treatment solution containing polycations (hereinafter, also referred to as "polycation treatment solution") and curl setting. Specifically, the stream treatment may be performed under an atmosphere where the temperature inside a container is above 100° C. and 200° C. or lower and the wet-bulb temperature is 50° C. or higher and lower than 100° C., or an atmosphere where the superheated steam temperature inside a container is above 100° C. and 200° C. or lower, for 20 seconds to 1 hour.

A treatment method using the polycation treatment solution may be any method that allows fibers to include polycations such as a quaternary amine compounds, and examples of the same include an immersion method and spraying. As the immersion method, a continuous immersion method and a batch immersion method may be adopted.

As the quaternary amine compounds, N,N-diallyl-N,N-dimethylammonium chloride homopolymers that are appropriately diluted to a predetermined concentration with ion-exchanged water may be used. Examples of the N,N-diallyl-N,N-dimethylammonium chloride homopolymers include "PAS-H-10L (product name)" (the weight average molecular weight: 200000, the concentration: 28 wt.-%) and "PAS-H-1L (product name)" (the weight average molecular weight: 8500, the concentration: 28 wt.-%) manufactured by Nittobo Medical Co., Ltd. The concentration of quaternary amine compounds in the treatment solution may be 0.05 to 30 wt.-%, or 0.5 to 10 wt.-%, or 1 to 5 wt.-%, from the viewpoint of uniformly treating the entire fibers without uneven concentration.

The artificial protein fibers such as regenerated collagen fibers after treatment with the treatment solution containing polycations such as quaternary amine compounds are dewatered by squeezing it by hand, a nip roll, and then dried. For example, the drying may be performed at a temperature of 120° C. or lower, or 80° C. or lower, or 50° C. or lower, for 1 to 5 hours.

Next, the artificial protein fibers such as regenerated collagen fibers are subjected to curl setting to impart curls to the fibers. Thus, the artificial protein fibers such as regenerated collagen fibers have curls. The method of the curl setting is not particularly limited, and may be determined appropriately depending on the purpose and intended use. Examples of the method include twisting, winding using a metal cylinder (pipe winding), and net processing (YAKI processing).

The order may be changed between the treatment with the polycation treatment solution and the curl setting, that is, the artificial protein fibers may be first curled and then treated with the polycation treatment solution. The curl setting property improves by performing the curl setting first and the treatment with the polycation treatment solution next. The shorter the length of the fibers (fiber bundle) after curling of the artificial hair, the better the curl setting property.

Hair ornamental products can be produced using the above protein fibers for artificial hair. The hair ornamental products may include other synthetic fibers for artificial hair in addition to the protein fibers for artificial hair. Examples of the other synthetic fibers for artificial hair include, but are not particularly limited to, polyvinyl chloride fibers, nylon fibers, modacrylic fibers, and polyester fibers.

Examples of the hair ornamental products include a bundle of fibers for artificial hair, a weave, a wig, a braid, a toupee, a hair extension, and a hair accessory. For example, the hair ornamental products may include 30 to 70 wt.-% of the protein fibers for artificial hair and 30 to 70 wt.-% of the other synthetic fibers for artificial hair.

EXAMPLES

Hereinafter, one or more embodiments of the present invention will be described in more detail based on examples. However, the present invention is not limited to the examples.

Example 1

<Wet Spinning>

A cowhide split leather was used as a raw material, and its collagen was solubilized with an alkali. The solubilized collagen thus obtained was dissolved in an aqueous lactic acid solution, and the solution was adjusted to obtain a pH 3.5 aqueous collagen solution with a collagen concentration of 7.5 wt.-%. The aqueous collagen solution thus obtained was stirred and defoamed under a reduced pressure, transferred to a piston type spinning base solution tank, left to stand under a reduced pressure, and deformed. The deformed aqueous collagen solution was then extruded by a piston, and a specified amount of the solution was sent by a gear pump and filtered through a sintered filter having a pore size of 10 μm. Then, the solubilized undiluted collagen after filtration was passed through a spinning nozzle having 275 pores with a pore size of 0.212 mm and discharged at a spinning rate of 5 m/minute into a 25° C. coagulation bath (having a pH adjusted to 11 with sodium hydrogen carbonate and sodium hydroxide) containing 17 wt.-% of sodium sulfate to obtain regenerated collagen fibers. The regenerated collagen fibers thus obtained were immersed in an aqueous solution containing 17 wt.-% of sodium sulfate, 0.02 wt.-% of sodium hydroxide, and 0.83 wt.-% of epichlorohydrin at 25° C. for 5 hours, further immersed therein at 43° C. for 3.5 hours, and then crosslinked with epoxide compounds.

<Treatments with Zirconium Salt and Phosphoric Acid Based Compounds>

The regenerated collagen fibers crosslinked with epoxide compounds obtained above were washed with water, and immersed in a treatment bath (having a pH adjusted to 3.0 with sodium hydroxide) containing 2.00 wt.-% of zirconium sulfate in terms of $ZrO_2$ and 0.56 wt.-% of citric acid monohydrate for 6 hours. The regenerated collagen fibers treated with zirconium salts were then washed with water, and immersed in a treatment bath (pH 11.0) containing 1.0 wt.-% of disodium hydrogen phosphate for 6 hours.

<Spinning Oil Emulsion Treatment>

The crosslinked regenerated collagen fibers thus obtained were washed with water, immersed in a bath filled with a spinning oil emulsion containing an amino-modified silicone emulsion and a polyether-based antistatic additive so as to make the spinning oil emulsion adhere to the fibers, followed by drying under tension condition using a uniform hot-air drier of 70° C.

The oiled regenerated collagen fibers obtained in the above-described manner had a zirconium sulfate content of 22.6 wt.-% in terms of $ZrO_2$ and a phosphorus content of 3.3 wt.-%. The zirconium salt content and the phosphorus content in the regenerated collagen fibers were measured and calculated as described later.

<Stream Treatment>

The stream treatment was performed by continuously supplying the oiled regenerated collagen fibers to a box-type uniform hot-air dryer set at 130° C. while adjusting the wet-bulb temperature to 80° C. by steam (source pressure: 0.4 MPa). The residence time in the drier was 10 minutes. The fibers after stream treatment were wound on a bobbin. Then, the bobbin was stored in a condition without condensation, moved to a constant-temperature and constant-humidity environment at 20° C. with a relative humidity of 65%, and left to stand for 4 hours or more.

<Preparation of Fiber Bundle>

The regenerated collagen fibers after stream treatment were cut into 25.4 cm long (10 inches) to prepare two fiber bundles (each bundle: 5 g, total weight: 10 g). One end of the fiber bundles was carefully aligned so that these two fiber bundles would not be mixed, and fixed using a rubber band at a position 0.5 inches away from the one end of the fiber bundles.

<Treatment with Polyamine Compound>

A N,N-diallyl-N,N-dimethylammonium chloride polymer (product name "PAS-H-1L" manufactured by Nittobo Medical Co., Ltd., the weight average molecular weight: 8500, the concentration: 28 wt.-%) was diluted to 0.1 wt.-% with ion-exchanged water to prepare polyamine compound treatment solution. The treatment solution thus prepared was adjusted at 25° C. and spread over a vat, in which the fiber bundles obtained above were immersed. After 1 hour immersion, the fiber bundles were taken out from the immersion vat and dewatered by squeezing them lightly by hand. The fiber bundles were further dewatered while adjusting the deposit efficiency of the polyamine compound treatment solution to the regenerated collagen fibers (the amount of the solution absorbed by the fibers) to 25 wt.-% with respect to the weight of the humidity-controlled regenerated collagen fibers. Next, the dewatered fiber bundles were dried for 1.5 hours with the fiber bundles being laid on a metal plate of a steam setter ("Steam Rice Cooker" manufactured by HWASHINKITCHEN IND CO LTD) stabilized at 75° C. Then, the fiber bundles that were stabilized at a wet-bulb temperature of 45° C. using an oven ("Perfect Oven PH-201" manufactured by ESPEC CORP) and dried using the steam setter were dried for 30 minutes with the fiber bundles being laid on the metal plate. In the present application, "the weight of the humidity-controlled regenerated collagen fibers" refers to the weight of regenerated collagen fibers prepared by the following manner: storing regenerated collagen fibers after stream treatment in a condition without condensation, moving them to a constant-temperature and constant-humidity environment at 20° C. with a relative humidity of 65%, and leaving them to stand for 4 hours or more.

<Curl Setting>

After treatment with polyamine compounds (hereinafter, also referred to as a "polyamine compound treatment") in the above-described manner, the two fiber bundles were each twisted in the right direction from an end of the fiber bundles on the side opposite the side where they were fixed by a rubber band. These twisted fiber bundles were further twisted together in the left direction with the free ends of the fiber bundles being matched, so that the fiber bundles were mutually intertwined. Thus, a twist processing was performed.

Example 2

Curled regenerated collagen fibers of Example 2 were obtained in the same manner as in Example 1 except that the polyamine compound treatment solution was prepared by diluting a N,N-diallyl-N,N-dimethylammonium chloride polymer (product name "PAS-H-1L" manufactured by Nittobo Medical Co., Ltd., the weight average molecular weight: 8500, the concentration: 28 wt.-%) with ion-exchanged water so that the concentration would be 1.0 wt.-%.

Example 3

Curled regenerated collagen fibers of Example 3 were obtained in the same manner as in Example 1 except that the polyamine compound treatment solution was prepared by diluting a N,N-diallyl-N,N-dimethylammonium chloride polymer (product name "PAS-H-1L" manufactured by Nittobo Medical Co., Ltd., the weight average molecular weight: 8500, the concentration: 28 wt.-%) with ion-exchanged water so that the concentration would be 20 wt.-%.

Example 4

Curled regenerated collagen fibers of Example 4 were obtained in the same manner as in Example 1 except that the polyamine compound treatment solution was prepared by diluting a N,N-diallyl-N,N-dimethylammonium chloride polymer (product name "PAS-H-10L" manufactured by Nittobo Medical Co., Ltd., the weight average molecular weight: 200000, the concentration: 28 wt.-%) with ion-exchanged water so that the concentration would be 0.1 wt.-%.

Example 5

Curled regenerated collagen fibers of Example 5 were obtained in the same manner as in Example 1 except that the polyamine compound treatment solution was prepared by diluting a N,N-diallyl-N,N-dimethylammonium chloride polymer (product name "PAS-H-10L" manufactured by Nittobo Medical Co., Ltd., the weight average molecular weight: 200000, the concentration: 28 wt.-%) with ion-exchanged water so that the concentration would be 1.0 wt.-%.

Example 6

Curled regenerated collagen fibers of Example 6 were obtained in the same manner as in Example 1 except that the polyamine compound treatment solution was prepared by diluting a N,N-diallyl-N,N-dimethylammonium chloride polymer (product name "PAS-H-10L" manufactured by Nittobo Medical Co., Ltd., the weight average molecular weight: 200000, the concentration: 28 wt.-%) with ion-exchanged water so that the concentration would be 20 wt.-%.

Example 7

Curled regenerated collagen fibers of Example 7 were obtained in the same manner as in Example 2 except that the order was changed between the polyamine compound treatment and the curl setting, i.e., the fibers were first curled as described below and then subjected to the polyamine compound treatment.

<Curl Setting>

After preparation of the fiber bundles, they were each twisted in the right direction from an end of the fiber bundles on the side opposite the side where they were fixed by a rubber band. These two twisted fiber bundles were further twisted together in the left direction with the free ends of the fiber bundles being matched, so that the fiber bundles were mutually intertwined. Thus, a twist processing was performed.

<Treatment with Polyamine Compound>

A N,N-diallyl-N,N-dimethylammonium chloride polymer (product name "PAS-H-1L" manufactured by Nittobo Medical Co., Ltd., the weight average molecular weight: 8500, the concentration: 28 wt.-%) was diluted to 1.0 wt.-% with ion-exchanged water to prepare polyamine compound treatment solution. The treatment solution thus prepared was adjusted at 25° C. and spread over a vat, in which the curled fiber bundles were immersed. After 1 hour immersion, the fiber bundles were taken out from the immersion vat and dewatered by squeezing them lightly by hand. The deposit efficiency of the polyamine compound treatment solution to the regenerated collagen fibers (the amount of the solution absorbed by the fibers) was 25 wt.-% with respect to the weight of the humidity-controlled regenerated collagen fibers. Next, the fiber bundles from which the treatment solution was removed were dried for 1.5 hours with the fiber bundles being laid on a metal plate of a steam setter ("Steam Rice Cooker" manufactured by HWASHIN KITCHEN IND CO LTD) stabilized at 75° C. Then, the fiber bundles that were stabilized at a wet-bulb temperature of 45° C. using an oven ("Perfect Oven PH-201" manufactured by ESPEC CORP.) and dried using the steam setter were dried for 30 minutes with the fiber bundles being laid on the metal plate.

Example 8

Curled regenerated collagen fibers of Example 8 were obtained in the same manner as in Example 3 except that the order was changed between the polyamine compound treatment and the curl setting, i.e., the fibers were first curled as described above and then subjected to the polyamine compound treatment.

Example 9

Curled regenerated collagen fibers of Example 9 were obtained in the same manner as in Example 5 except that the order was changed between the polyamine compound treatment and the curl setting, i.e., the fibers were first curled as described above and then subjected to the polyamine compound treatment.

Example 10

Curled regenerated collagen fibers of Example 10 were obtained in the same manner as in Example 6 except that the order was changed between the polyamine compound treatment and the curl setting, i.e., the fibers were first curled as described above and then subjected to the polyamine compound treatment.

Example 11

Curled regenerated collagen fibers of Example 11 were obtained in the same manner as in Example 9 except that the treatments with zirconium salts and phosphoric acid based compounds were not performed but a treatment with aluminum salts was performed as described below, and the stream treatment was not performed.

<Treatment with Aluminum Salt>

The regenerated collagen fibers crosslinked with epoxide compounds were washed with water, and immersed in a treatment bath (having a pH adjusted to 4.0 with sodium hydroxide) containing 0.86 wt.-% of aluminum sulfate in terms of $Al_2O_3$ and 0.64 wt.-% of citric acid monohydrate. Sodium hydroxide was added thereto per 2 hours to adjust the pH of the treatment bath to 5 for 10 hours.

The regenerated collagen fibers of Example 11 contained 17.1 wt.-% of aluminum sulfate in terms of $Al_2O_3$. The aluminum salt content in the regenerated collagen fibers was measured and calculated as described later.

Comparative Example 1

Curled regenerated collagen fibers of Comparative Example 1 were obtained in the same manner as in Example 1 except that the fiber bundles were not treated with polyamine compounds, but treated with ion-exchanged water as described below.

<Treatment with Ion-Exchanged Water>

Ion-exchanged water was adjusted at 25° C. and spread over a vat, in which the fiber bundles were immersed. After 1 hour immersion, the fiber bundles were taken out from the immersion vat and dewatered by squeezing them lightly by hand. Then, the dewatered fiber bundles were dried for 1.5 hours with the fiber bundles being laid on a metal plate of a steam setter ("Steam Rice Cooker" manufactured by HWASHINKITCHEN IND CO LTD) stabilized at 75° C. Next, the fiber bundles that were stabilized at a wet-bulb temperature of 45° C. using an oven ("Perfect Oven PH-201" manufactured by ESPEC CORP.) and dried using the steam setter were dried for 30 minutes with the fiber bundles being laid on the metal plate.

Comparative Example 2

Curled regenerated collagen fibers of Comparative Example 2 were obtained in the same manner as in Example 11 except that the fiber bundles were not treated with polyamine compounds, but treated with ion-exchanged water as described above.

<Methods for Measuring Concentrations of Zr, Al and P in Fiber>

<Pretreatment>

Regenerated collagen fibers dried at 105° C. for 2 hours were used as a sample. About 0.1 g of sample was accurately weighed, and then was put in a TFM (Teflon (Registered Trademark)) decomposition vessel. Next, sulfuric acid (ultrahigh-purity sulfuric acid from Kanto Chemical Co., Ltd.), nitric acid (ultrahigh-purity nitric acid from Kanto Chemical Co., Ltd.) and hydrofluoric acid (ultrahigh-purity hydrofluoric acid from Kanto Chemical Co., Ltd.) were added to the vessel to carry out pressurized acid decomposition using a microwave decomposition device. Thereafter, the volume of the decomposition liquid was adjusted to 50 mL with deionized water (electrical resistivity: 3.0 Ω·cm or more), and then the volume-adjusted decomposition liquid was diluted with deionized water (electrical resistivity: 3.0 Ω·cm or more) as appropriate, thus obtaining a liquid to be measured.

<Measurement Method>

Through ICP emission spectrochemical analysis (ICP emission spectrophotometer "ICPS-8100" from Shimazu Corporation), the concentration of each element in the sample was measured by the absolute calibration curve method, where Y are used as an internal standard substance (measurement wavelength: 371.029 nm). At the same time, a blank test was also carried out. The measurement wavelengths used for Zr, Al, and P were 343.823 nm, 396.153 nm, and 213.620 nm, respectively.

<Calculation Method>

The concentration of each element in the fibers was calculated using the following formula.

Concentration(wt.-%) of each element in fibers=[ICP measurement value of sample (mg/L)−ICP measurement value of blank (mg/L)]×50 (mL)×dilution factor/[weight of sample (g)×10000]

<Expression in Terms of Oxide>

(1) The zirconium oxide content was calculated using the following formula.

Zirconium oxide content (wt.-%)=Zr concentration in fibers (wt.-%)/molar weight of Zr(91.2 g/mol)×molar weight of $ZrO_2$(123.2 g/mol)

(2) The aluminum oxide content was calculated using the following formula.

Aluminum oxide content (wt.-%)=Al concentration in fibers (wt.-%)/molar weight of Al(27.0 g/mol)×[molar weight of $Al_2O_3$(102.0 g/mol)/2]

The shampoo resistance of the curled regenerated collagen fibers (fiber bundles) obtained in Examples 1-11 and Comparative Examples 1-2 were evaluated as described below. Table 1 below shows the results. Table 1 also shows the kind of the polyamine compounds and the concentration thereof in the treatment solution, and the order of the polyamine compound treatment ("immersion" in Table 1) and the curl setting ("setting" in Table 1). In Table 1 below, "pDADMAC" represents a N,N-diallyl-N,N-dimethylammonium chloride polymer.

(Shampoo Resistance)

<1st Shampoo>

A water bath was prepared by spreading 25° C. ion-exchanged water over a vat. The curled regenerated collagen fibers (fiber bundle) were immersed in the vat for 10 minutes, and then combed twenty times using a comb (product name "New Delrin Smooth 826" manufactured by Uehara Cell). The combed fiber bundle was dewatered by squeezing it lightly by hand, then stabilized at a wet-bulb temperature of 45° C. using an oven (product name "Perfect Oven PH-201" manufactured by ESPEC CORP.), and dried for 1.5 hours with the fiber bundle being laid on a metal plate.

<2nd Shampoo>

The fiber bundle dried after 1st shampoo was subjected to 2nd shampoo in the same manner as in the 1st shampoo process.

<Percentage of Loosened Curls by Shampoo>

A length L1 of the fiber bundle before shampoo and a length L2 thereof after two times of shampoo were measured in the manner described below to calculate a percentage of loosened curls of the fiber bundle by the following formula.

$$\text{Percentage of loosened curls (\%)}=(L2-L1)/L1\times 100$$

(Length of Fiber Bundle)

The fiber bundle was laid on a flat plate, and a distance between the both ends of the fiber bundle was determined as a length of the fiber bundle.

TABLE 1

| | The order of Treatment | Polyamine compound | | Length of fiber bundle (cm) | | Percentage of loosened curls (%) |
|---|---|---|---|---|---|---|
| | | Name | Concentration (wt.-%) | Before shampoo | After shampoo | |
| Ex. 1 | Immersion -> Setting | pDADMAC (weight average molecular weight: 8500) | 0.1 | 19.5 | 22.8 | 16.9 |
| Ex. 2 | Immersion -> Setting | | 1.0 | 19.5 | 22.8 | 16.9 |
| Ex. 3 | Immersion -> Setting | | 20 | 19.5 | 23.5 | 20.5 |
| Ex. 4 | Immersion -> Setting | pDADMAC (weight average molecular weight: 200000) | 0.1 | 19.0 | 22.5 | 18.4 |
| Ex. 5 | Immersion -> Setting | | 1.0 | 19.0 | 22.5 | 18.4 |
| Ex. 6 | Immersion -> Setting | | 20 | 19.0 | 22.5 | 18.4 |
| Ex. 7 | Setting -> Immersion | pDADMAC (weight average molecular weight: 8500) | 1.0 | 18.5 | 22.0 | 18.9 |
| Ex. 8 | Setting -> Immersion | | 20 | 18.5 | 22.0 | 18.9 |
| Ex. 9 | Setting -> Immersion | pDADMAC (weight average molecular weight: 200000) | 1.0 | 18.5 | 22.0 | 18.9 |
| Ex. 10 | Setting -> Immersion > | | 20 | 18.5 | 22.0 | 18.9 |
| Ex. 11 | Setting -> Immersion | | 1.0 | 19.5 | 22.7 | 16.4 |
| Comp. Ex. 1 | Immersion -> Setting | Not added | | 19.5 | 24.5 | 25.6 |
| Comp. Ex. 2 | Setting -> Immersion | Not added | | 20.5 | 24.5 | 19.5 |

Ex.: Example,
Comp. Ex.: Comparative Example

As can been seen from the results of Table 1 above, the curled regenerated collagen fibers of Examples 1-10 had a lower percentage of loosened curls after repeated shampoo and exhibited a higher shampoo resistance of curls than the curled regenerated collagen fibers of Comparative Example 1. Further, the curled regenerated collagen fibers of Example 11 had a lower percentage of loosened curls after repeated shampoo and exhibited a higher shampoo resistance of curls than the curled regenerated collagen fibers of Comparative Example 2.

It was confirmed from a comparison between Examples 2, 3 and Examples 7, 8, and a comparison between Examples 5, 6 and Examples 9, 10 that the regenerated collagen fibers that were first curled and then treated with polyamine compounds resulted in a shorter fiber bundle after the artificial hair curl setting (before shampoo), stronger curls, and a better curl setting property than the regenerated collagen fibers that were first treated with polyamine compounds and then curled.

Although the disclosure has been described with respect to only a limited number of embodiments, those skilled in the art, having benefit of this disclosure, will appreciate that various other embodiments may be devised without departing from the scope of the present invention. Accordingly, the scope of the invention should be limited only by the attached claims.

What is claimed is:

1. Protein fibers for artificial hair, comprising a polycation, wherein the protein fibers for artificial hair are crosslinked with an organic compound and/or a metal salt, a protein constituting the protein fibers for artificial hair is collagen, the organic compound is epihalohydrin and/or a hydrogen halide adduct of epihalohydrin, the metal salt is an aluminum salt and/or a zirconium salt, the polycation is a homopolymer of a N,N-diallyl-N,N-dimethylammonium salt and/or a copolymer of a N,N-diallyl-N,N-dimethylammonium salt, and the protein fibers for artificial hair have curls.

2. The protein fibers for artificial hair according to claim 1, wherein the protein fibers for artificial hair are water-insoluble regenerated collagen fibers.

3. The protein fibers for artificial hair according to claim 1, wherein the protein fibers for artificial hair contain at least one selected from the group consisting of phosphoric acid based compounds, sulfuric acid based compounds, and carboxylic acid compounds.

4. The protein fibers for artificial hair according to claim 1, wherein the epihalohydrin is epichlorohydrin.

5. A method for producing the protein fibers for artificial hair according to claim 1, comprising:

treating artificial protein fibers that are crosslinked with an organic compound and/or a metal salt with a treatment solution containing a polycation, and curling the artificial protein fibers, or curling artificial protein fibers that are crosslinked with an organic compound and/or a metal salt, and treating the curled artificial protein fibers with a treatment solution containing a polycation, wherein a protein constituting the artificial protein fibers is collagen, the organic compound is epihalohydrin and/or a hydrogen halide adduct of epihalohydrin, the metal salt is an aluminum salt and/or a zirconium salt, and the polycation is a homopolymer of a N,N-diallyl-N,N-dimethylammonium salt and/or a copolymer of a N,N-diallyl-N,N-dimethylammonium salt.

6. A hair ornamental product comprising the protein fibers for artificial hair according to claim 1.

7. The hair ornamental product according to claim 6, further comprising other synthetic fibers for artificial hair.

8. The hair ornamental product according to claim 6, wherein the hair ornamental product is one selected from the group consisting of a bundle of fibers for artificial hair, a weave, a wig, a braid, a toupee, a hair extension, and a hair accessory.

* * * * *